US009620895B2

(12) United States Patent
Hastings et al.

(10) Patent No.: US 9,620,895 B2
(45) Date of Patent: Apr. 11, 2017

(54) LATCH TO GENERATE POSITIVE LOCKING LATCH RETENTION FORCE TO RETAIN MEMORY MODULE

(71) Applicant: Hewlett-Packard Development Company, L.P., Houston, TX (US)

(72) Inventors: Robert J Hastings, Spring, TX (US); Joseph Allen, Tomball, TX (US); Minh H Nguyen, Katy, TX (US); James Jeffery Schulze, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 14/761,339

(22) PCT Filed: Jan. 23, 2013

(86) PCT No.: PCT/US2013/022724
§ 371 (c)(1),
(2) Date: Jul. 16, 2015

(87) PCT Pub. No.: WO2014/116214
PCT Pub. Date: Jul. 31, 2014

(65) Prior Publication Data

US 2015/0357755 A1 Dec. 10, 2015

(51) Int. Cl.
*H01R 13/62* (2006.01)
*H01R 13/627* (2006.01)
(Continued)

(52) U.S. Cl.
CPC ..... *H01R 13/6275* (2013.01); *H01R 12/7005* (2013.01); *H01R 24/76* (2013.01); *H01R 43/205* (2013.01); *Y10T 29/49224* (2015.01)

(58) Field of Classification Search
CPC ..... H01R 12/7005; H01R 12/721; H01R 12/7058; H01R 13/62988; H05K 7/1409
(Continued)

(56) References Cited

U.S. PATENT DOCUMENTS 3,767,974 A * 10/1973 Donovan, Jr. ..... H05K 7/1409 200/292
5,074,800 A 12/1991 Sasao et al.
(Continued)

FOREIGN PATENT DOCUMENTS

JP 2001-126810 A 5/2001
JP 2001-196130 A 7/2001
(Continued)

OTHER PUBLICATIONS

Removing and Replacing Parts: Dell PowerEdge 1300 Systems Service Manual, Retrieved from Internet Sep. 6, 2012 <http://support.dell.com/support/edocs/systems/sgeck/sm/remove.htm>.
(Continued)

*Primary Examiner* — Vanessa Girardi
(74) *Attorney, Agent, or Firm* — Hewlett Packard Enterprise Patent Department

(57) ABSTRACT

A socket is to receive a memory module usable in a computing system. A latch is to retain the memory module seated in the socket. The latch is to generate a positive locking latch retention force to prevent removal of the memory module while the latch is in a latched position.

14 Claims, 7 Drawing Sheets

(51) Int. Cl.
*H01R 24/76* (2011.01)
*H01R 43/20* (2006.01)
*H01R 12/70* (2011.01)

(58) Field of Classification Search
USPC ..... 439/157, 160, 325, 327, 328
See application file for complete search history.

(56) References Cited

U.S. PATENT DOCUMENTS

| | | | | |
|---|---|---|---|---|
| 5,634,803 | A | 6/1997 | Cheng et al. | |
| 5,637,004 | A | 6/1997 | Chen et al. | |
| 5,980,282 | A | 11/1999 | Cheng | |
| 6,390,837 | B1 | 5/2002 | Lee | |
| 6,855,009 | B2 * | 2/2005 | Nishiyama ..... | H01R 12/721 439/325 |
| 7,004,773 | B1 | 2/2006 | Poh et al. | |
| 8,087,950 | B1 | 1/2012 | Deng et al. | |
| 2009/0035979 | A1 | 2/2009 | Kerrigan et al. | |
| 2009/0077293 | A1 | 3/2009 | Kerrigan et al. | |

FOREIGN PATENT DOCUMENTS

| | | | |
|---|---|---|---|
| JP | 2006-202615 | A | 8/2006 |
| KR | 2011-0003816 | A | 1/2011 |

OTHER PUBLICATIONS

PCT/ISA/KR, International Search Report mailed Oct. 18, 2013, 10 pps., PCT/US2013/022724.

* cited by examiner

LATCH TO GENERATE POSITIVE LOCKING LATCH RETENTION FORCE TO RETAIN MEMORY MODULE

BACKGROUND

A socket may include latches to retain a memory module. The socket and latch may be arranged such that an unseating force on the memory module may generate a negative torque on the latches. The negative torque on the latch may cause such "self-opening" latches to open outward and allow the memory module to unseat from the socket. Thus, unseating may occur in the field under a loading condition from vibration, shock, transportation, and/or normal operating conditions. To unseat a memory module, the applied load and negative torque need be just enough to overcome a friction force in equilibrium holding the latch. When this equilibrium is lost, the latch opens outward and the memory module unseats.

BRIEF DESCRIPTION OF THE DRAWINGS/FIGURES

DETAILED DESCRIPTION

Examples provided herein provide an unseating-resistant connector (e.g., latch and/or socket) for a memory module. The system may enable a latch to provide positive torque, providing self-latch functionality under a load that would otherwise unseat the memory module.

In an example, a socket and latch assembly cooperate to produce a positive locking torque that may be applied from the latch onto the memory module, to resist unseating forces such as shock and vibe loading conditions. By creating a positive locking (positive torque) latching effect, memory modules may be secure during transportation and operation in the field. Example latches are compatible with various systems, including storage and/or server products and personal computing devices.

Figure 1:
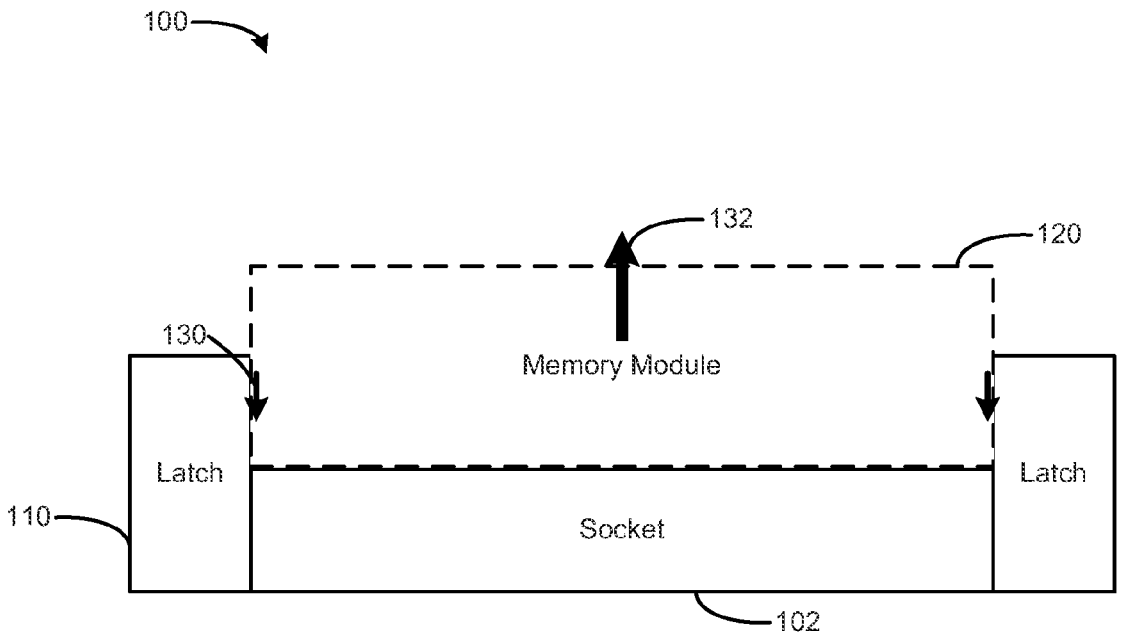
FIG. 1 is a block diagram of a system including a latch according to an example.

FIG. 1 is a block diagram of a system 100 including a latch 110 according to an example. System 100 also includes a socket 102 to receive the memory module 120. Latch 110 may provide a latch retention force 130 to counteract an unseating force 132 (e.g., shock, vibration, etc.), so that the memory module 120 may remain secured in the socket 102.

Latch 110 may provide the latch retention force 130 based on a positively locking interaction. For example, latch 110 may apply force based on a moment arm to resist unseating in shock and vibe environments. Thus, example latch 110 may provide resistance to opening in response to a load (e.g., unseating force 132), unlike other latches that will open under an unseating force 132 such as vibration or pulling on the memory module 120.

The system 100, including latch 110 and/or the socket 102, may be compliant with various types of memory and memory standards. For example, system 100 may comply with single in-line memory modules (SIMMs), dual in-line memory modules (DIMMs), and others. System 100 may comply with standards such as the Joint Electron Devices Engineering Council (JEDEC) Solid State Technology Association's JESD79-3E document defining support for memory modules such as various dynamic random access memory (DRAM) modules including double data rate (DDRx), where x is an integer indicating memory variation (e.g., DDR2, DDR3, DDR4, and so on). However, system 100 may be compliant with other memory standards and modules, including synchronous, asynchronous, graphics, and other types of memory modules that interface with a latch.

Figure 2:
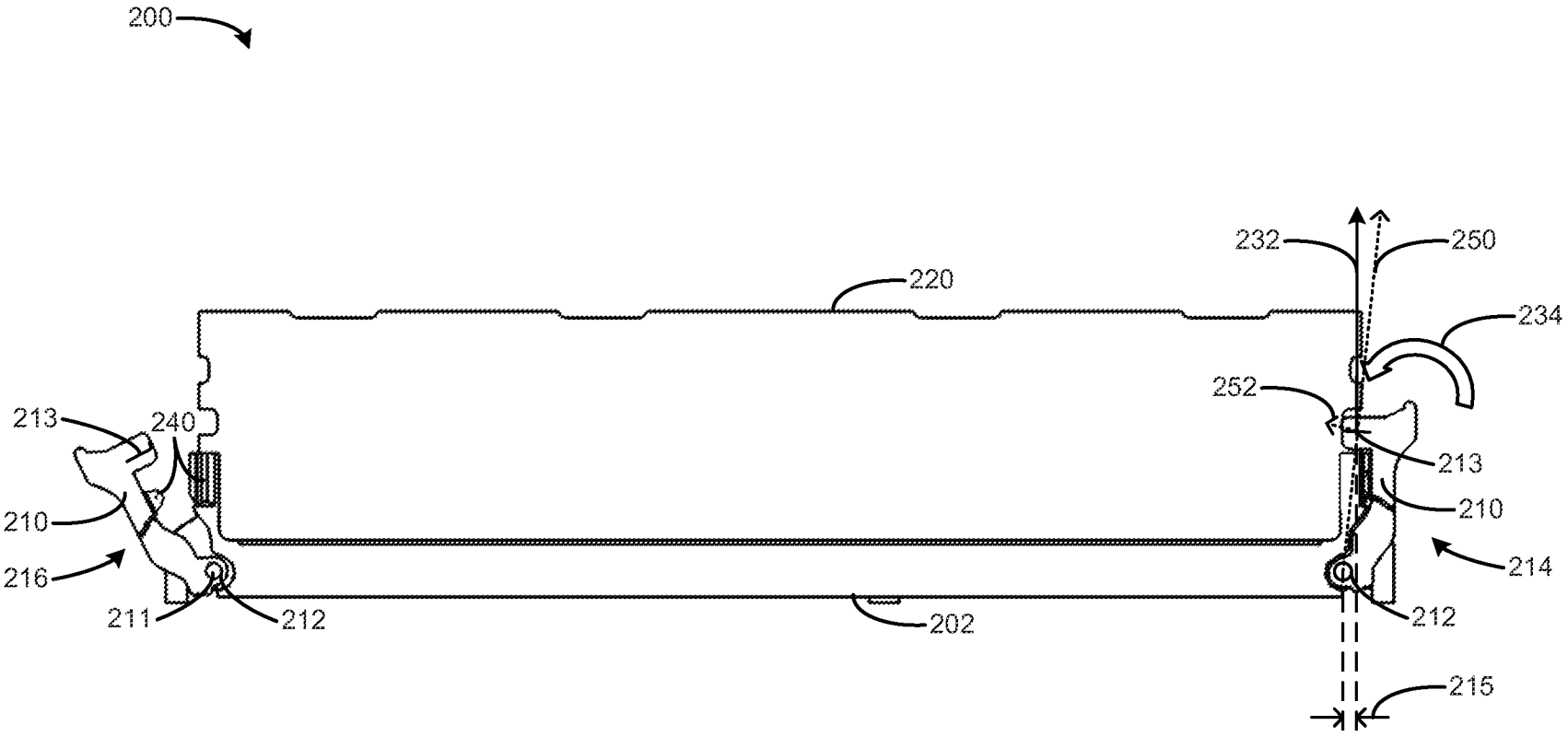
FIG. 2 is a block diagram of a system including a latch according to an example.

FIG. 2 is a block diagram of a system 200 including a latch 210 according to an example. System 200 also includes a socket 202 to retain memory module 220. Latch 210 is movable about latch pivot 212, between a latched position 214 and an unlatched position 216 (and may be pivotable to other positions not specifically shown). Latch pivot 212 may pivotably couple the latch 210 and socket 202 based on a pivot pin 211, for example. System 200 may include a detention feature 240, which may be implemented as a feature of the latch 210 and/or the socket 202 (FIG. 2 shows detention features on both the latch 210 and on a vertical extension of socket 202). The latch detention feature 240 may provide a latch detention force, to stabilize the latch 210 in the latched position 214.

System 200 may be provided as a 3-piece construction of two latches 210 and one socket 202, wherein a latch 210 is provided as a separate piece that may be assembled to the socket 202. The latch 210 may be snapped on to the socket 202 at the latch pivot 212, e.g., based on extensions and dimples at the latch 210 and/or socket 202. In an alternate example, the latch 210 may be coupled to the socket 202 based on a pivot pin 211, which may pass through a portion of the latch 210 and socket 202. In an example, the pivot pin 211 may connect through two outer legs of the latch 210 via a through-hole of the socket 202, the pivot pin 211 secured with a force fit. Other suitable techniques may be used to pivotably couple the latch 210 to the socket 202. For example, the latch pivot 212 may be based on a virtual pivot point that coincides with the illustrated latch pivot 212, e.g., by using a plurality of levers to form a coupling that physically interfaces at points other than the illustrated latch pivot 212. Thus, the latch pivot 212 (which may include a virtual latch pivot 212) may be provided at an offset 215 relative to a latch contact region 213 of the latch 210. The socket 202 is shown as a unitary piece, but may be provided as separate components (e.g., system 200 may be provided based on a 4-piece (or more) construction where the socket 202 is formed of multiple pieces).

The latch contact region 213 of latch 210 is to interact with the memory module 220. The latch contact region 213 may provide a latch retention force by contacting the memory module 220, e.g., establishing a moment arm relative to the latch pivot 212. The latch contact region 213 may contact an upward facing surface of a cutout/notch of the memory module 220. The memory module 220 is shown with two sets of cutouts, to accommodate different latching heights that may be used. Thus, latch 210 (and latch contact region 213) may interface at various heights, including the heights shown by the cutouts in the memory modules, as well as other low-profile heights wherein latches 210 may interface with a low profile memory module (e.g., to enable airflow or accommodate geometry constraints).

The detention feature 240 is to provide a latch detention force to stabilize the latch 210 in the latched position 214. Although the latch detention force of the detention feature 240 may affect the latching torque 234, the latching torque 234 is generated independently of the latch detention force as set forth below. The detention feature 240 may involve interaction between the latch 210 and socket 202. In alternate examples, the detention feature 240 may involve interaction directly between the latch 210 and the memory module 220 (e.g., a detention feature 240 on the latch 210 that frictionally grips the memory module 220). In an example, there may be a spring loaded arm/clip extending from the latch 210 to grab onto a portion of the socket 202 as shown. The detention feature 240 is shown about midway along a height of the latch 210 in the example of FIG. 2. In alternate examples, the detention feature 240 may be positioned higher or lower on the latch 210, and may be integrated with the latch pivot 212. The detention feature 240 may be based on a detent to allow the latch 210 to snap into a desired position, such as latched position 214, intermediate positions, unlatched positions 216, and so on. The detent and corresponding dimple may be formed in the latch 210 and/or the socket 202.

The detention feature 240 thereby helps maintain the latch 210 in the latched position 214 based on the latch detention force, by enabling the latch 210 to snap into place when the memory module 202 is fully seated down whereby the latch 210 is pivoted to the latched position 214.

The latch 210 is to provide a positive latching torque 234. The positive latching torque 234 may be generated based on various forces caused by the latch 210 and its interaction with the memory module 220 and latch pivot 212. In resting equilibrium, unseating force 232 is zero. When unseating force 232 (e.g., pulling up the memory module 220) is introduced without unlatching the latches 210, the memory module may push against the latch contact regions 213 of the latches 210. In reaction, the latch 210 may generate the positive latching torque 234 to maintain the latch 210 in the latched position 214. The latching torque 234 is based on a torque moment arm between the latch contact region 213 and the latch pivot 212, keeping the latch 210 closed despite the unseating force 232. Thus, as the unseating force 232 increases, the latching torque 234 similarly may increase, to maintain the latch 210 in the latched position 214. The positive direction of the latching torque 234, to maintain the latched position 214, is not present in other latches whose geometric arrangement will cause such latches to pop open when exposed to an unseating force 232. In such latches, the unseating force 232 would generate a negative torque that would overwhelm any minor latch detention friction/spring-type forces. The positive latching torque 234 to retain the memory module 220 may be generated independent of friction forces, and may increase to counteract any increase in the unseating force 232 (e.g., may increase until a breakdown of structural integrity of the material that forms system 200).

The latch 210 is to provide the latch retention force to counteract the unseating force 232 (e.g., the latch retention force may be a force in the opposite direction of the unseating force 232). The latch 210 and arrangement of the latch contact region 213 and latch pivot 212 may illustrate that forces may be resolvable into a first component vector 250 and a second component vector 252. The first component vector 250 extends along an axis between the latch contact region 213 and the latch pivot 212. The latch 210 may withstand the first component vector 250 based on a structural/material strength to maintain physical integrity of a shape of the latch 210. The second component vector 252 extends along an axis perpendicular to the first component vector 250, away from the latch 210 and toward the memory module 220. Thus, the second component vector 252 contributes to the positive latching torque 234, maintaining the latch 210 in the latched position 214.

The first component vector 250 and second component vector 252, and latching torque 234, may be affected by offset 215. The offset 215 is a distance associated with the latch pivot 212 being positioned inward, relative to the latch 210, of the latch contact region 213. The inside offset 215 may contribute to generation of the positive latching torque 234 in response to the unseating force 232. The positive latching torque 234 may increase in response to an increase in the unseating force 232.

Thus, example latches described herein may locate the latch pivot 212 to induce a positive latching torque 234 when the memory module 220 is under an applied load (unseating force 232, including shock and vibration). The positive latching torque 234 may result from the pivot point being located more inward towards the memory module 220 than the latch contact region 213, where the latch and notch of the memory module 220 interact. Accordingly, as a larger load is applied, the positive locking self-latching torque 234 may hold the memory module 220 even tighter. Examples may be designed such that rather than popping open under load, the first point of failure would be the natural material property of the socket 202 and/or latch 210 (or latch pivot 212) yielding, in contrast to popping open after overcoming a friction grip associated with other latches lacking the positive latching torque 234 (e.g., other latches that generate a negative torque to push open the latches under load).

The location of the pivot point 212 relative to the latch 210 and/or latch contact region 213 enable example systems to provide a self-latching tendency under an applied load that may be experienced in the field (e.g., during transportation, shocks, vibration, earthquakes, and so on). As a greater load is applied (e.g., unseating force 232 as shown, including forces applied in non-vertical directions), the force holding the memory module 220 in the socket 202 will increase, thereby preventing the latches 210 from popping open and the memory module 220 from becoming unseated. Thus, unseating failures experienced in the field will be minimized. The first point of failure of the socket 202 may now be designed as a function of the material strength itself, rather than a balance of equilibrium of moments and forces that may depend on friction.

Figure 3:
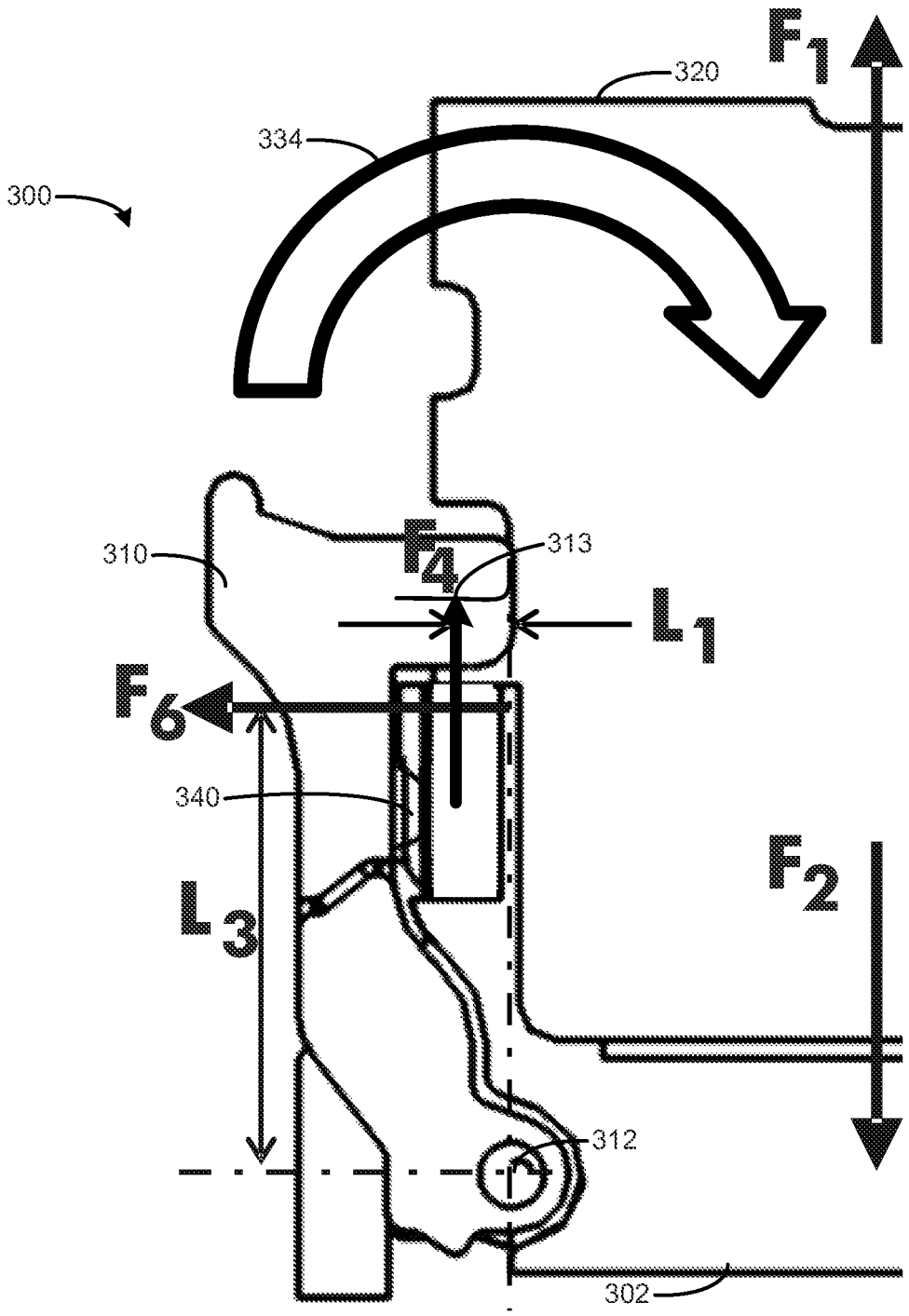
FIG. 3 is a block diagram of a system including a latch according to an example.

FIG. 3 is a block diagram of a system 300 including a latch 310 according to an example. The latch 310 is pivotably coupled to the socket 302 based on latch pivot 312. Latch 310 may include a detention feature 340 and a latch contact region 313 to contact memory module 320. Latch 310 may provide positive latching torque 334 in response to $F_4$ (e.g., $F_4$ may be expressed as a function of unseating force $F_1$, such as $F_4=\frac{1}{2}F_1$). FIG. 3 illustrates the latching torque 334 in terms of example forces and moments.

$F_1$ is a force to unseat the memory module 320. $F_1$ may represent system 300 experiencing a vibration, which may be expressed as a weight of the memory module 320 multiplied by a g-load. $F_2$ may represent a contact retention force, which may be provided by a friction fit of the memory module 320 into the socket 302. $F_4$ may represent a force experienced by the latch contact region 313 of the latch 310, caused by contact with a notch cutout of the memory module 320. $F_6$ may represent a resistance force experienced by the socket 302. $L_1$ may represent a first moment arm, associated with a distance from the latch pivot 312 to a region of the latch 310 that experiences force $F_4$ (e.g., at the latch contact region 313). $L_3$ may represent a second moment arm, associated with a distance from the latch pivot 312 to $F_6$.

A force equilibrium of system 300 may be expressed in terms of $F_4$. $F_4$ was chosen for convenience as a common term between the force and moment equilibrium equations, though the equilibriums may be expressed as a function of other terms as desired. One latch 310 is shown corresponding to one end of the memory module 320, and the following equations are expressed in terms of the load being shared by two latches 310 to secure both ends of the memory module 320, each latch 310 associated with its own $F_4$, as follows:

$$\Sigma F \text{ (at equilibrium)}=0=F_1-F_2+2F_4$$

$$2F_4=F_2-F_1$$

$$F_4=(F_2-F_1)/2$$

A moment equilibrium of system 300 may be expressed in terms of $F_4$, as follows:

$$\Sigma M \text{ (at equilibrium)}=0=F_4L_1-F_6L_3$$

$$F_4L_1=F_6L_3$$

$$F_4=F_6L_3/L_1$$

Combining the force equilibrium equation (expressed in terms of $F_4$) and the moment equilibrium equation (also expressed in terms of $F_4$) by setting them equal to each other, results in the following expression of $F_1$:

$$(F_2-F_1)/2=F_6L_3/L_1$$

$$F_2-F_1=2F_6L_3/L_1$$

$$F_1=F_2-2F_6L_3/L_1$$

Thus, the equilibrium equations show that as $F_1$ increases, the latch 310 closes tighter. The resulting "positive torque" may develop due to the location of the latch pivot 312 inward of the latch contact region 313, to provide an offset for $L_1$, which is the moment arm from the latch pivot 312 to $F_4$.

Figure 4A:
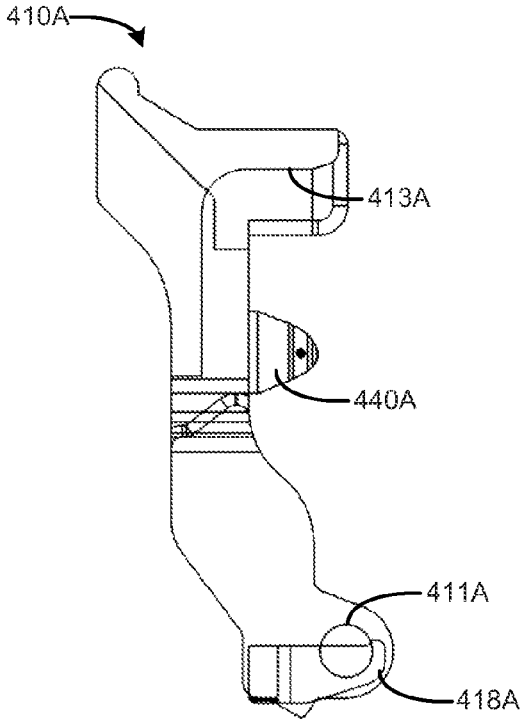
FIG. 4A is a side view of a latch according to an example.

FIG. 4A is a side view of a latch 410A according to an example. Latch contact region 413A, detention feature 440A, pivot pin 411A, and extension 418A are visible. Note that latch contact region 413A, pivot pin 411A, and extension 418A are made visible by illustrating a side wall of the latch 410A as transparent.

Latch 410A provides an example of an offset between the pivot pin 411A and the latch contact region 413A. Thus, when the latch contact region 413A experiences a force to unseat a memory module, a portion of that force is converted into a latching torque to cause the latch 410A to pivot closed about the pivot pin 411A and grip more tightly on the memory module.

The detention feature 440A is shown including a dimple to interact with a bump (e.g., located on a vertical extension of a socket). In alternate examples, the detention feature 440A may include a spring clip or other mechanism to provide a latch detention force to stabilize the latch 410A in a latched position. The detention feature 440A may interact directly with a memory module, e.g., including extensions that face inward to grip either face of an edge of a memory module.

The extension 418A may enable a self-latching and ejecting function for the latch 410A. Upon installation of the memory module, with the latch 410A in an unlatched position, the extension 418A of the latch 410A may contact a bottom edge of the memory module. This contact may cause the latch 410A to pivot closed, self-latching onto the memory module (e.g., cause the detention feature 440A to engage, and cause the latch contact region 413A to be brought into contact with a top edge of the memory module). The extension 418A also may provide an eject function, enabling the latch 410A to eject a seated memory module upon unlatching the latch 410A. For example, pivoting the latch 410A from a latched position to an unlatched position, causing the extension 418A to push upward on a bottom edge of the memory module.

Figure 4B:
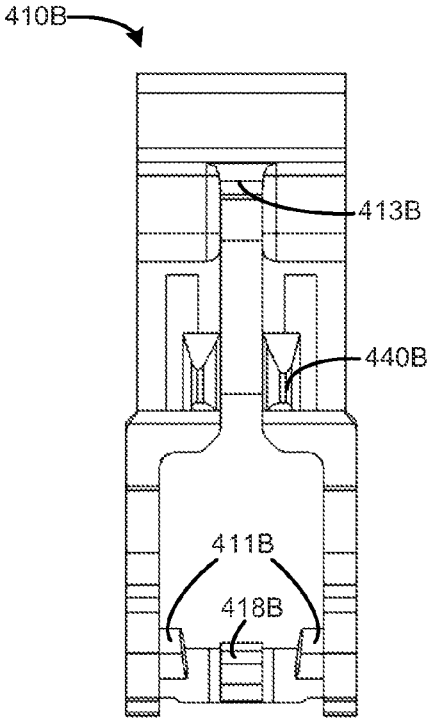
FIG. 4B is a front view of a latch according to an example.

FIG. 4B is a front view of a latch 410B according to an example. Latch contact region 413B and detention feature 440B are indicated as shown. Front view of latch 410B also illustrates pivot pin 411B and extension 418B. Pivot pin 411B is shown using an open axle structure that may facilitate a snap-together assembly to interface with corresponding dimples on a socket. In alternate examples, the pivot pin 411B may be provided separately, passed through corresponding holes in the latch 410B.

Figure 4C:
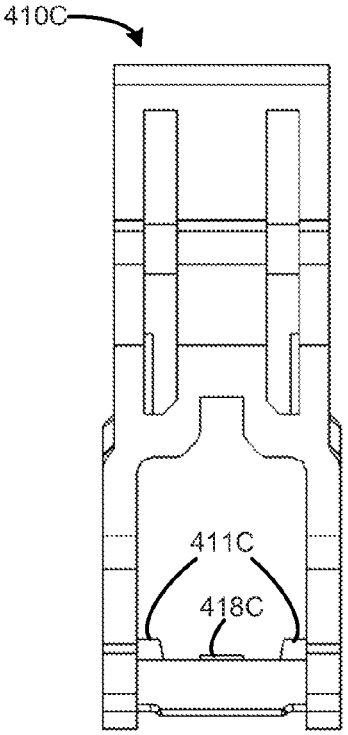
FIG. 4C is a back view of a latch according to an example.

FIG. 4C is a back view of a latch 410C according to an example. Portions of pivot pin 411C and extension 418C are visible.

Figure 4D:
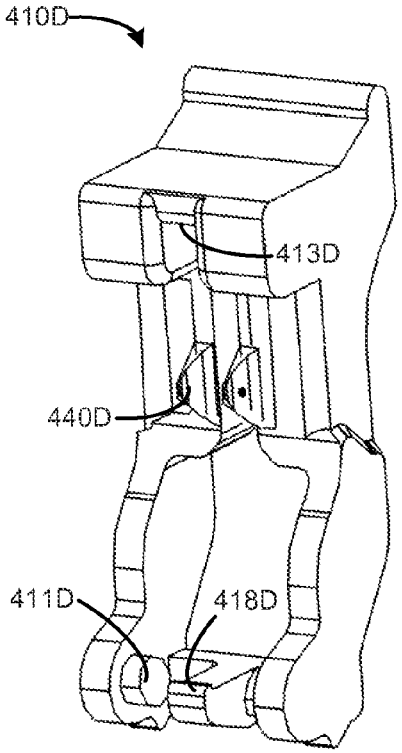
FIG. 4D is a perspective view of a latch according to an example.

FIG. 4D is a perspective view of a latch 410D according to an example. The perspective view illustrates latch contact region 413D, detention feature 440D, pivot pin 411D, and extension 418D.

The detention feature 440D is shown in two sections, although other examples are possible. Thus, the detention feature 440D may offer a spring tension/friction grip based on the two sections being deflected. For example, the detention feature 440D may grip outer surfaces of an edge of a memory module. The detention feature 440D also may grip inner surfaces of a corresponding vertical extension of a socket. Alternatively, the detention feature 440D may be provided as a single portion that is to be gripped by the vertical extension of a socket.

Figure 5A:
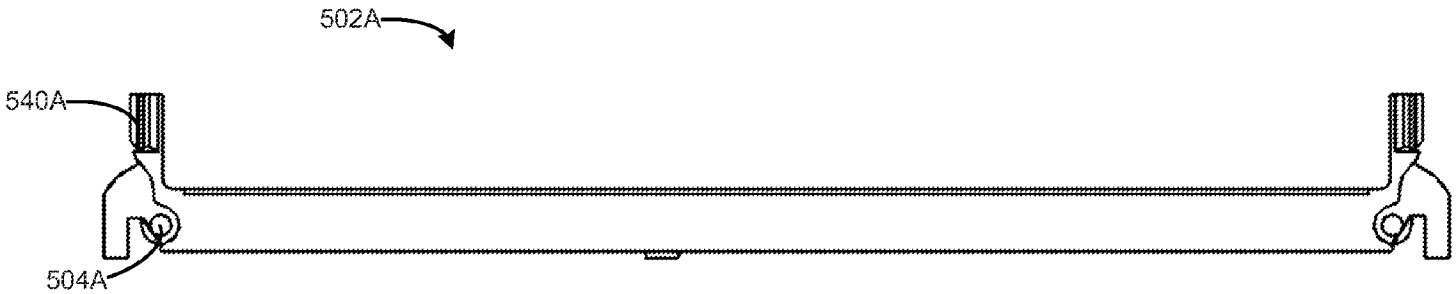
FIG. 5A is a front view of a socket to be used with a latch according to an example.

FIG. 5A is a front view of a socket 502A to be used with a latch according to an example. The socket 502A may include a pivot hole 504A and detention feature 540A.

The detention feature 540A of the socket 502A is provided as a vertical extension, and may correspond to a detention feature of a latch. For example, the socket detention feature 540A may be designed to be gripped by the latch, or the socket detention feature 540A may be designed to grip the latch. The vertical extension socket detention feature 540A also may include a slot to guide insertion of the memory module. In alternate examples, the pivot hole 504B may be provided as a pivot pin to correspond to pivot holes of a latch.

Figure 5B:
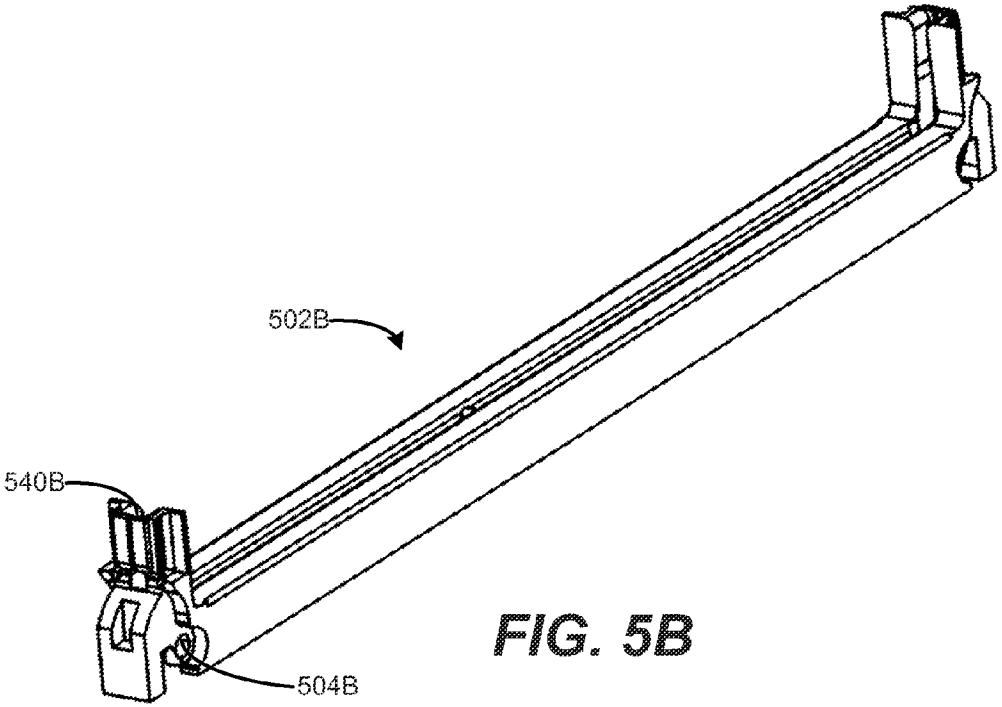
FIG. 5B is a perspective view of a socket to be used with a latch according to an example.

FIG. 5B is a perspective view of a socket 502B to be used with a latch according to an example. The socket 502B is shown with a pivot hole 504B and detention feature 540B.

Figure 6:
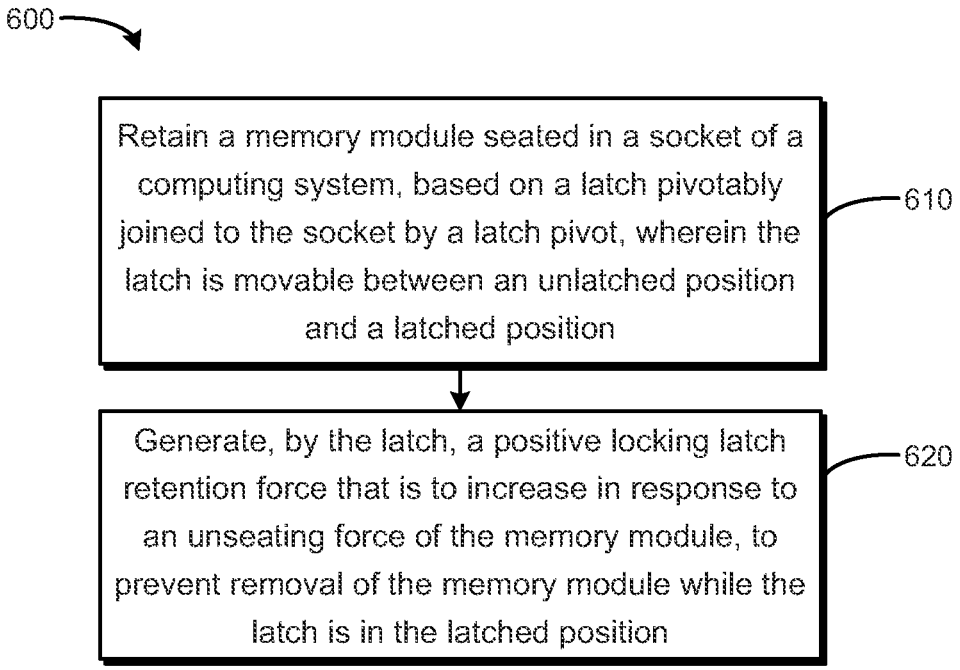
FIG. 6 is a flow chart based on generating a latch retention force according to an example.

FIG. 6 is a flow chart 600 based on generating a latch retention force according to an example. In block 610, a memory module is retained seated in a socket of a computing system, based on a latch pivotably joined to the socket by a latch pivot, wherein the latch is movable between an unlatched position and a latched position. For example, the latch may be pivotably joined based on a snap-together assembly of a latch pin and corresponding socket dimple. In block 620, the latch is to generate a positive locking latch retention force that is to increase in response to an unseating force of the memory module, to prevent removal of the memory module while the latch is in the latched position. For example, the latch pivot may be offset from a latch contact region to provide a positive latching torque that causes the latch retention force to increase.

Figure 7:
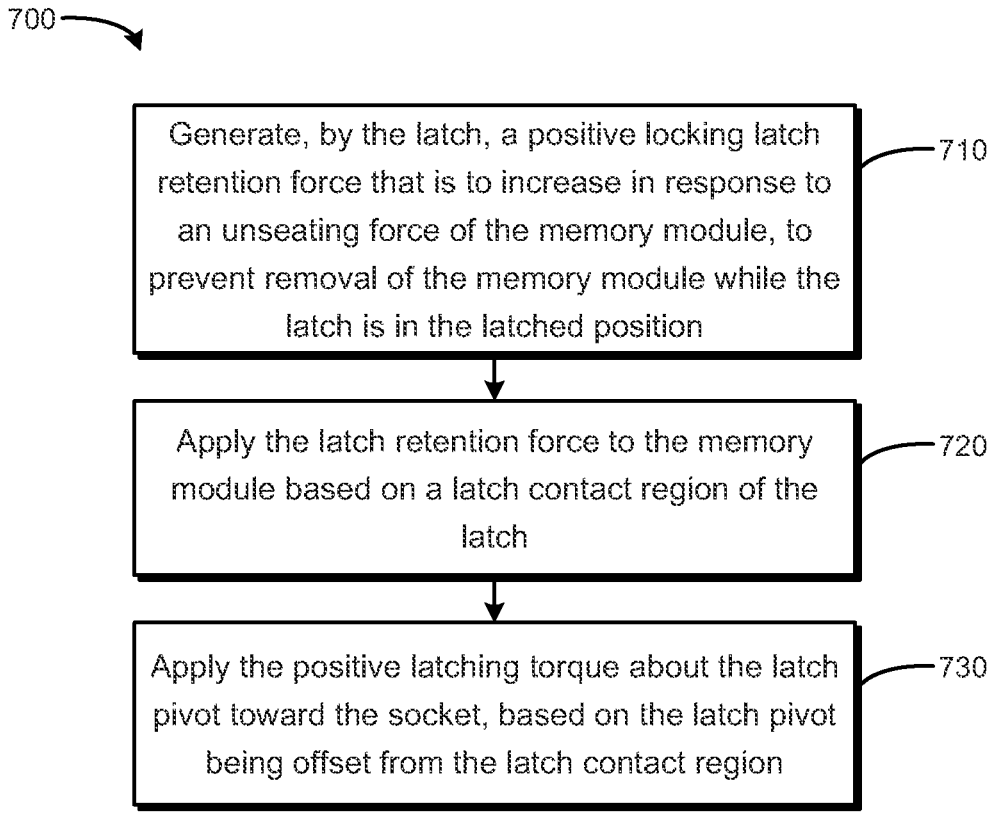
FIG. 7 is a flow chart based on applying a latch retention force according to an example.

FIG. 7 is a flow chart 700 based on applying a latch retention force according to an example. In block 710, the latch is to generate a positive locking latch retention force that is to increase in response to an unseating force of the memory module, to prevent removal of the memory module while the latch is in the latched position. In block 720, the latch retention force is applied to the memory module based on a latch contact region of the latch. In block 730, the positive latching torque is applied about the latch pivot toward the socket, based on the latch pivot being offset from the latch contact region.

What is claimed is:

1. A computing system comprising:

a socket to receive a memory module; and a latch pivotably joined to the socket via a latch pivot to retain the memory module seated in the socket;

wherein the latch includes a latch contact region to apply a latch retention force to the memory module, wherein the latch pivot is offset from the latch contact region to generate a positive locking latch retention force to prevent removal of the memory module while the latch is in a latched position, and wherein the latch retention force is resolvable to a first component vector, along an axis between the latch contact region and the latch pivot, and a second component vector perpendicular to the first component vector and extending away from the latch.

2. The computing system of claim 1, wherein the latch and socket are to interface with a dual in-line memory module (MINI).

3. The computing system of claim 2, wherein the latch and socket are to interface with a low-profile memory module.

4. A system comprising:

a socket to receive a memory module usable in a computing system;

a latch to retain the memory module seated in the socket; and a latch pivot to pivotably join the latch to the socket;

wherein the latch is to generate a positive locking latch retention force that is to increase in response to an unseating force of the memory module, to prevent removal of the memory module while the latch is in a latched position;

wherein the latch further con rises a latch contact region to apply the latch retention force to the memory module; and wherein the latch pivot is offset from the latch contact region such that the latch retention force is resolvable to a first component vector, along an axis between the latch contact region and the latch pivot, and a second component vector perpendicular to the first component vector and extending away from the latch.

5. The system of claim 4, wherein the latch pivot is offset from the latch contact region in a direction away from the latch and toward the socket.

6. The system of claim 4, wherein the latch pivot is based on a pivot pin of the latch and a corresponding pivot hole of the socket, and the latch is to pivotably join the socket based on a snap-together assembly.

7. The system of claim 4, wherein the latch pivot is based on a first pivot hole in the latch, and a second pivot hole in the socket, and the latch is pivotably joined with the socket based on a pivot pin passing through the first pivot hole and the second pivot hole.

8. The system of claim 4, wherein the latch includes an extension to engage the memory module upon insertion to cause the latch to actuate to latch onto the memory module in the latched position; wherein the extension is to eject the memory module upon actuation of the latch from the latched position to an unlatched position.

9. The system of claim 4, wherein the latch is to generate the latch retention force based on a positive latching torque acting about the latch pivot.

10. The system of claim 9, wherein the latch pivot is offset from the latch contact region to cause the latch to apply the positive latching torque about the latch pivot toward the socket.

11. The system of claim 4, wherein the latch includes a detention feature to provide a latch detention force to stabilize the latch in the latched position to engage the memory module.

12. The system of claim 11, wherein the detention feature is to provide the latch detention force based on a spring force provided by the detention feature, independently of the latch retention force.

13. A method, comprising:

retaining a memory module seated in a socket of a computing system, based on a latch pivotably joined to the socket by a latch pivot, wherein the latch is movable between an unlatched position and a latched position, and the latch includes a latch contact region;

generating, by the latch; a positive locking latch retention force that is to increase in response to an unseating force of the memory module, to prevent removal of the memory module while the latch is in the latched position, wherein the latch retention force is resolvable to a first component vector a on an axis between the latch contact region and the latch pivot, and a second component vector perpendicular to the first component vector and extending away from the latch.

14. The method of claim 13, further comprising applying the latch retention force to the memory module based on a latch contact region of the latch; and applying the positive latching torque about the latch pivot toward the socket, based on the latch pivot being offset from the latch contact region.

* * * * *